US005836343A

United States Patent [19]

Jones

[11] Patent Number: 5,836,343

[45] Date of Patent: Nov. 17, 1998

[54] PUMPS AND PUMP HANDLING APPARATUS

[75] Inventor: James Jones, Warrington, England

[73] Assignee: British Nuclear Fuels PLC, Risley, England

[21] Appl. No.: 433,806

[22] Filed: May 3, 1995

Related U.S. Application Data

[63] Continuation of Ser. No. 15,871, Feb. 10, 1993, abandoned, which is a continuation of Ser. No. 638,132, Dec. 24, 1990, abandoned, which is a continuation of Ser. No. 282,063, Dec. 9, 1988, abandoned.

[30] Foreign Application Priority Data

Dec. 17, 1987 [GB] United Kingdom ..... 8729481

[51] Int. Cl.[6] ..... B65H 75/34

[52] U.S. Cl. ..... 137/355.26; 137/355.21; 242/388.7; 254/291; 254/294

[58] Field of Search ..... 137/355.17, 355.2, 137/355.21, 355.26; 254/291, 294; 242/388.7

[56] References Cited

U.S. PATENT DOCUMENTS

| | | | |
|---|---|---|---|
| 3,145,725 | 8/1964 | Knights | 137/355.17 |
| 3,396,747 | 8/1968 | Moore | 137/355.21 |
| 3,516,433 | 6/1970 | Guinot | 137/355.26 |
| 3,758,078 | 9/1973 | Grenn | 242/86.5 |
| 4,058,295 | 11/1977 | Morfitt | 254/291 |
| 4,323,222 | 4/1982 | Dempster et al. | 254/274 |
| 4,508,281 | 4/1985 | Plater | 242/54 R |
| 4,623,509 | 11/1986 | Fabris | 242/86 |

FOREIGN PATENT DOCUMENTS

| | | |
|---|---|---|
| 0216582 | 4/1987 | European Pat. Off. . |
| 754540 | 11/1933 | France . |
| 575170 | 2/1946 | United Kingdom . |
| 1332321 | 10/1973 | United Kingdom . |
| 2021507 | 12/1979 | United Kingdom . |
| 2158031 | 11/1985 | United Kingdom . |

*Primary Examiner*—A. Michael Chambers
*Attorney, Agent, or Firm*—D. Peter Hochberg; William H. Holt; William R. Hinds

[57] ABSTRACT

An electric pump 13 is mounted on a support 24 and can be raised and lowered using chains 25 driven by a motor.

Supply cable 14 for the pump is stored on drum 15. Fluid is discharged by the pump through hose 17 stored on drum 18.

A spray ring 20 attached to the pump is supplied with water through hose 21 stored on drum 22. The drums are rotated by hydraulic motors 32 and chains eg 36, 37. As the pump is raised at a uniform speed the drums are rotated to take up the slack hose and cable. The height of the pump is sensed from movement of the pump motor and the pressure supplied to the hydraulic motors is changed in discrete steps to maintain the wind up speed on to the drums despite the change in weight of unwound hose or cable.

6 Claims, 5 Drawing Sheets

PUMPS AND PUMP HANDLING APPARATUS

This is a continuation of application Ser. No. 08/015,871 filed Feb. 10, 1993, now abandonded which is a continuation of Ser. No. 07/638,132 filed Dec. 24, 1990, now abandoned, which is a continuation of application Ser. No. 07/282,063 filed Dec. 9, 1988, now abandoned.

This invention relates to pumps and pump handling apparatus.

According to this invention handling apparatus for a pump comprises a drum on which an elongate member for connection to the pump can be wound and unwound as the pump is raised and lowered in relation to the drum, a motor for rotating the drum to wind the elongate member onto the drum, and means for controlling the motor in dependence on the unwound amount of elongate member to avoid slack in the elongate member.

The controlling means may be dependent on the weight of the unwound elongate member.

The apparatus may comprise a first drum associated with a first hose for supplying fluid to the pump, a first motor for rotating the first drum to wind the first hose onto the first drum, a second drum associated with a second hose for discharge of fluid medium by the pump, a second motor for rotating the second drum to wind the second hose onto the second drum, a third drum associated with electric cable for the pump, and a third motor for rotating the third drum to wind the cable onto the third drum, the controlling means being operative to control the first, second and third motors in dependence on the unwound amount of the respective hose or cable to avoid slack in the first and second hoses and the cable.

The first and second and third motors may be hydraulic motors.

The apparatus may include a support on which a pump can be mounted, and means for raising and lowering the support.

The control means may comprise means for maintaining the wind up speed substantially irrespective of the weight of the respective hose or cable unwound from the respective drum.

The wind up speed may be maintained by varying the energy supply to the respective motor in dependence on the height of the pump support. The energy supply may be varied in discrete steps.

The invention includes the combination of pump handling apparatus as above and a pump connected to the apparatus to be raised and lowered.

The invention may be performed in various ways and one specific embodiment with possible modifications will now be described by way of example with reference to the accompanying drawings, in which.

Figure 1:
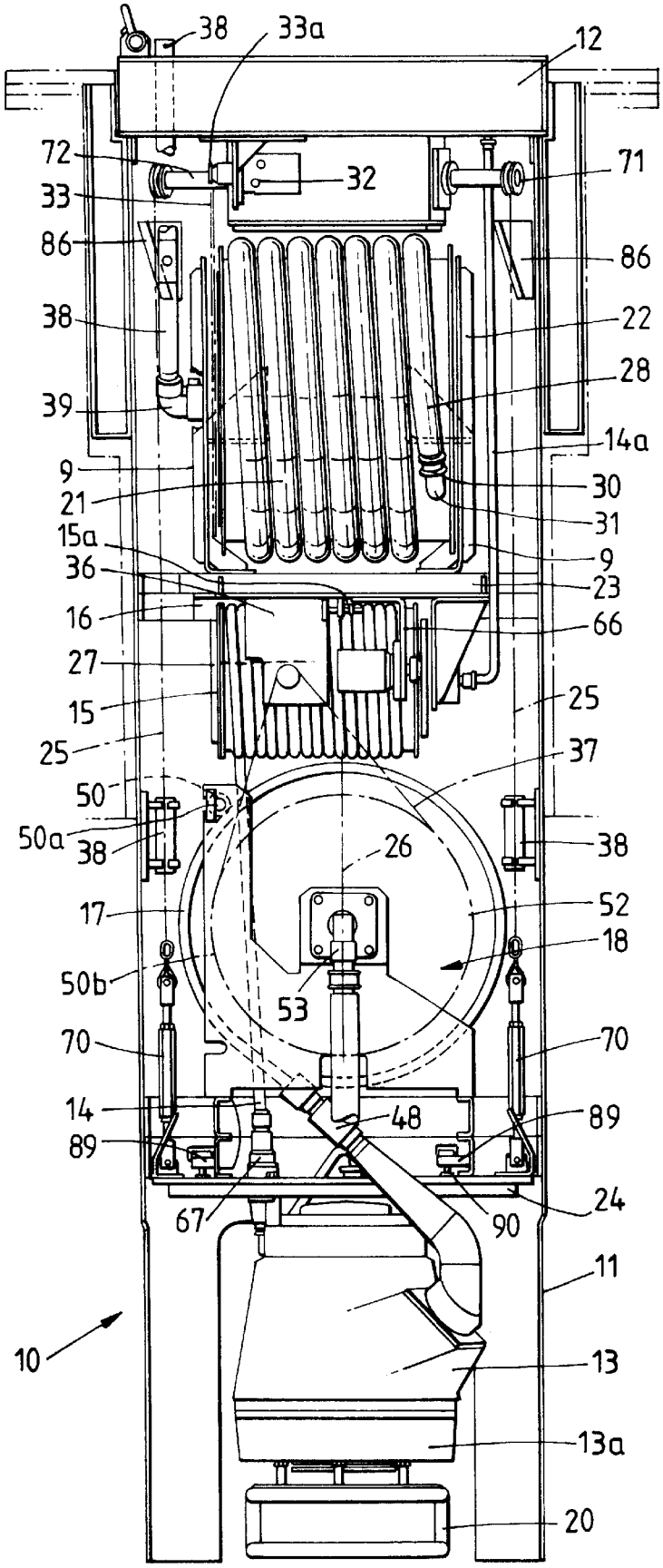
FIG. 1 is a side view of a pump handling system with part omitted.
Figure 2:
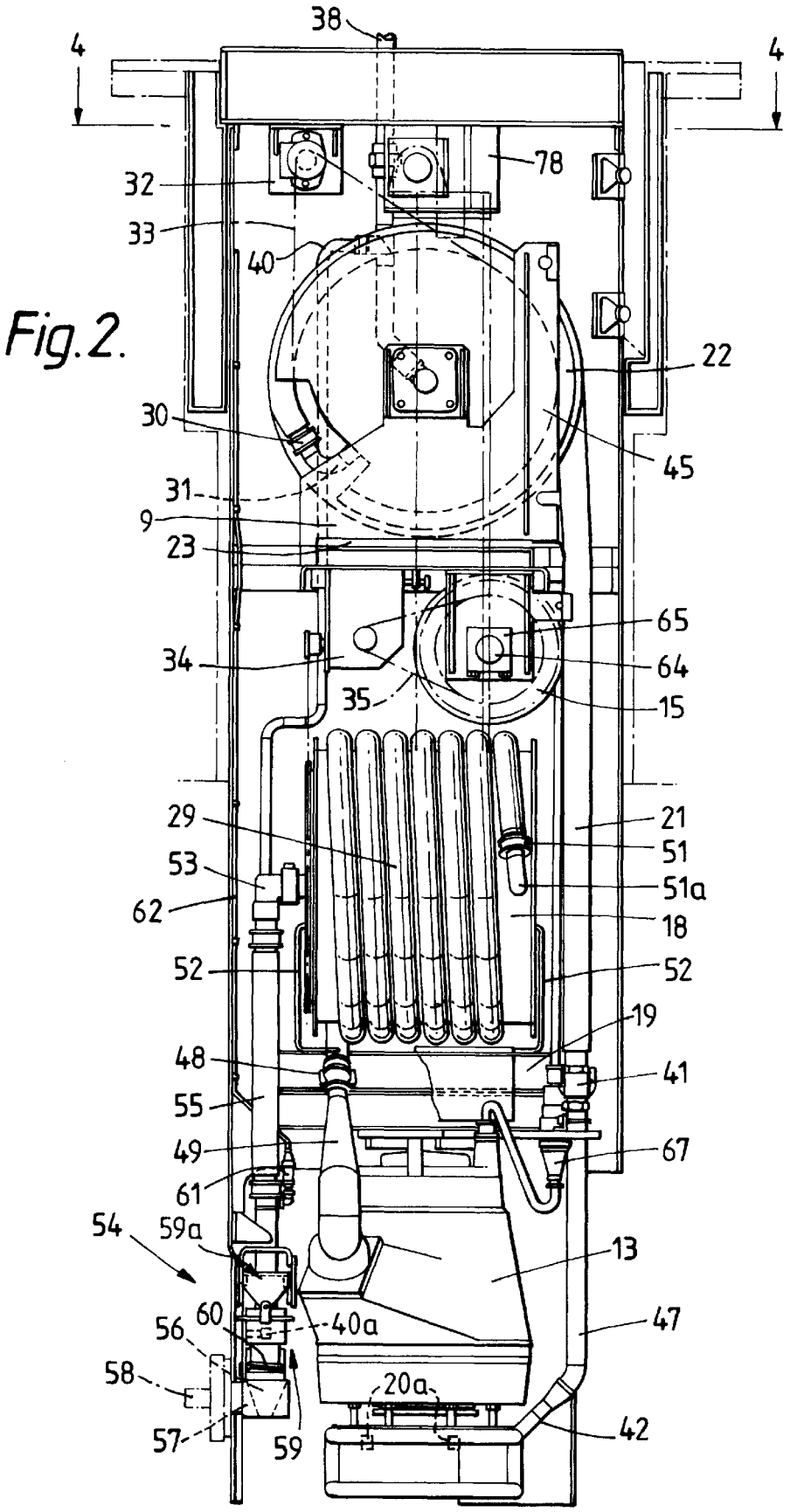
FIG. 2 is a view from the right of FIG. 1 with part omitted.

A pump handling system 10 as illustrated generally comprises a housing for a submersible pump capable of being lowered and raised, for example by about 14.5 m. The medium to be pumped is fluidised locally at the pump intake by means of a water spray ring. Water is passed through the top of the housing, via a hose wrapped over a drum down to the spray ring. The medium being pumped travels up the pump discharge, through a hose wrapped over a discharge drum, and through a remote coupling to for example a fixed pipe or a transfer tank. Electric power is provided to the pump by means of a cable, from the top or lid of the housing over a cable reeling drum, to a plug and socket on a pump mounting plate. The pump is attached to a plate whose weight is supported by two linked chains which are powered by a bevel gearbox, driven by a motorised gear unit mounted on the housing lid. The free chain is collected in two boxes mounted inside the housing.

In more detail, a housing 11 has a top or lid 12 and contains a pump 13 which can be raised into the housing or lowered therefrom, for example into a tank from which a medium is to be pumped. The pump 13 is electrically powered through a cable 14 which is stored on a drum 15 rotatably mounted in the housing 11 on a frame 16.

Medium discharged by the pump 13 passes through a discharge hose 17 stored on a drum 18 rotatably mounted in the housing 11 on a support 19.

Fluidizing of the medium to be pumped is assisted by water supplied to a spray ring 20 with nozzles 20*a* around the intake to the pump 13 through a supply hose 21 stored on a drum 22. The drum 22 is rotatably mounted in the housing 11 by means of a shaft each end of which is received in bearings secured to a bracket 9 carried on a support 23.

The pump 13 is mounted from a plate 24 which is raised and lowered through two chains 25 on opposite sides of the housing axis 26.

The axis 27 of rotation of the cable drum 15 is parallel to the axis 28 of rotation of the supply drum 22 and at right angles to the axis 29 of rotation of the discharge drum 18.

The upper end of the supply hose 21 is connected to a coupling 30 on the drum 22. The coupling 30 is connected to a hose 31 which extends within the drum 22 and is rotatably connected to an elbow 39 at one end of the drum and on the axis of rotation. The elbow 39 in turn is connected to a supply pipe 38 which extends through the lid 12.

The supply drum 22 is rotated by an hydraulic motor 32 through drive transmission 33.

The cable drum 15 is rotated by an hydraulic motor 34 through drive transmission 35.

The discharge drum 18 is rotated by an hydraulic motor 36 through drive transmission 37.

Figure 5:
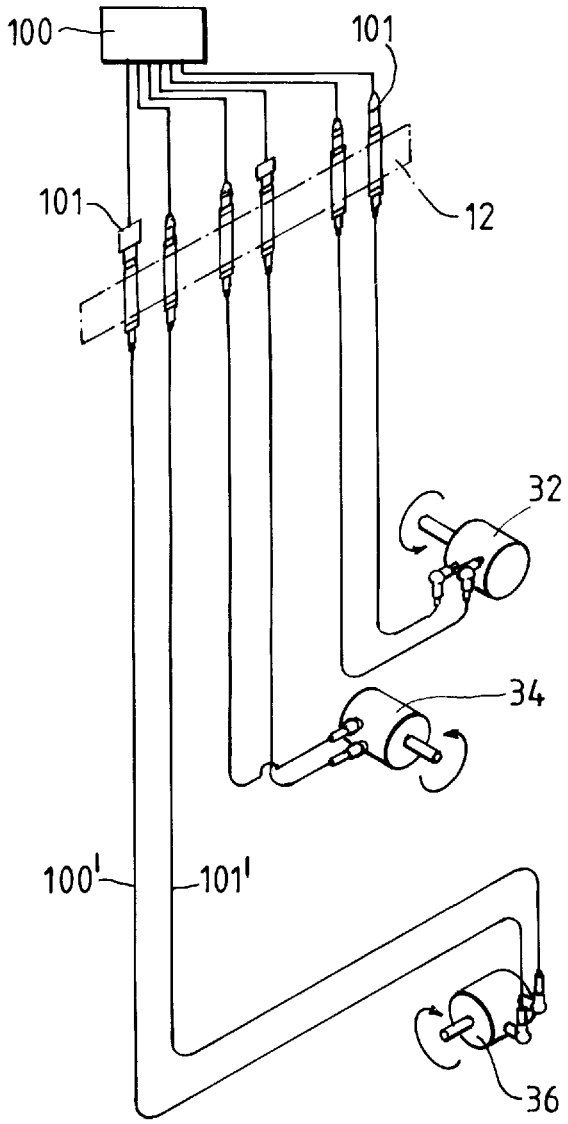
FIG. 5 is a hydraulic circuit.
Figure 6:
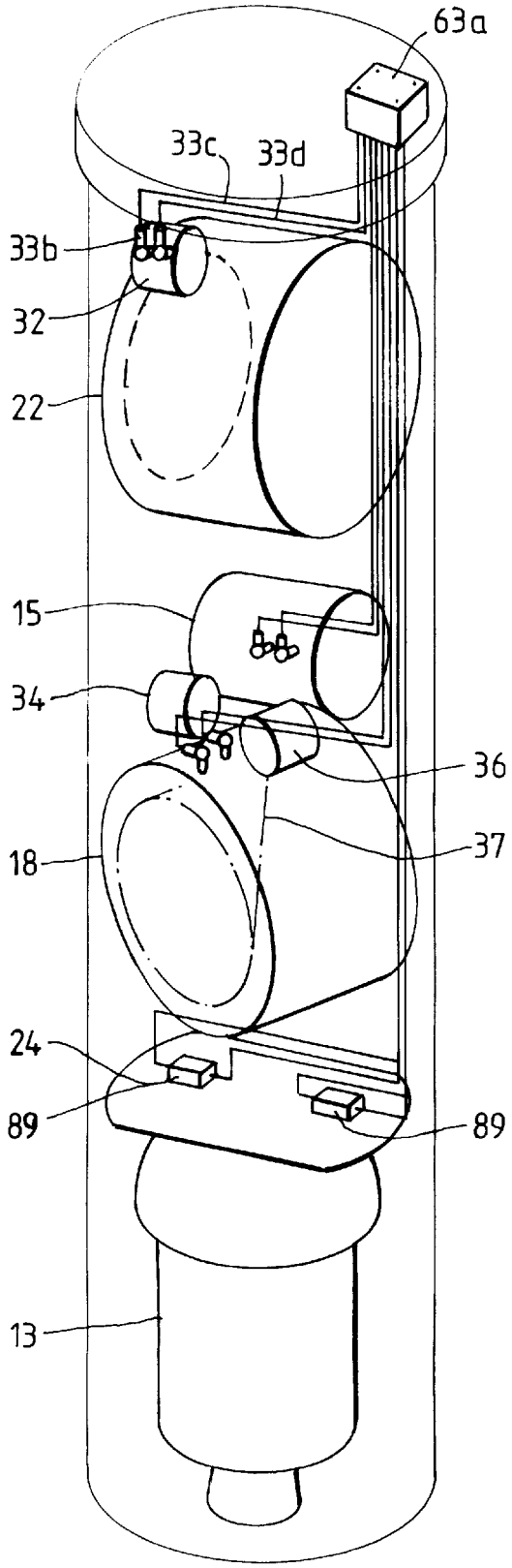
FIG. 6 shows a fibre optic system.

FIG. 5 shows a hydraulic circuit for the motors each having supply and return lines 100', 101'.

The pump 13 is powered by an electric motor which drives a multi-blade impeller. The medium being pumped is fluidised by means of spray jets attached to the spray ring 20 bolted to the pump base 13*a*. The fluidised medium is discharged from the pump through the discharge pipe 17. The pump 13 is secured to the mounting plate 24 using spacer pillars.

Figure 4:
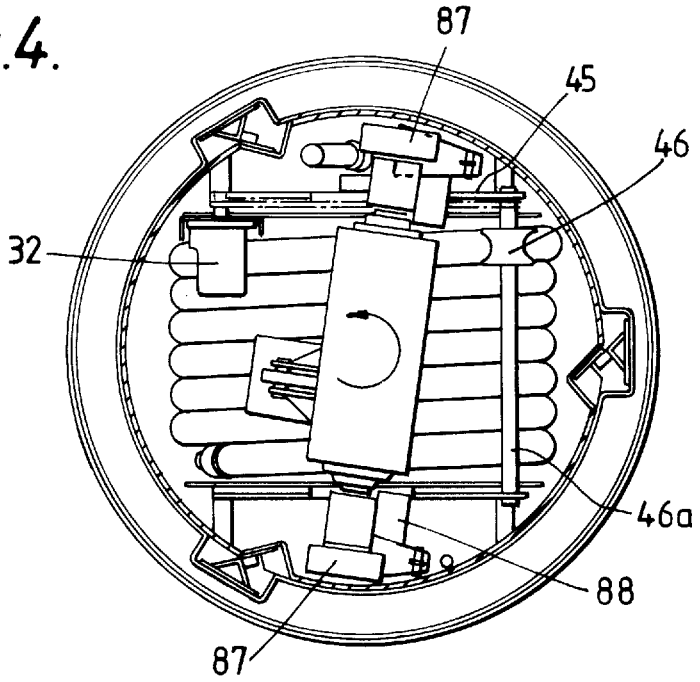
FIG. 4 is a section on the line 4—4 of FIG. 2.

The spray hose 21 locates in a spiral groove formed in the surface of the drum 22. A rotatable concave roller 46 (FIG. 4) located on and movable along a spindle 46*a* extending between brackets 45 functions to maintain the hose in the spiral groove during winding and unwinding.

The spray hose 21 is connected at the lower end by a releasable coupling 41 to a pipe 47 carried by the pump mounting plate 24 and leading to the spray ring 20.

The discharge hose 17 is connected by a quick release coupling 48 to a discharge pipe 49 clamped to the pump. The hose 17 wraps round the discharge drum 18 and locates in a spiral groove formed on the drum shell. A concave roller 50 rotatable on and movable along a spindle 50*a* carried in brackets 50*b* ensures the hose 17 is tightly wrapped on the drum 18. The other end of the discharge hose is connected by a coupling 51 at one end of the drum to a hose 51*a* which extends through the drum and is rotatably connected to an elbow 53 at the other end of the drum.

The discharge drum 18 has a central shaft which is mounted in bearings at each end. The bearings are fastened to brackets 52, which are mounted on the support 19.

The elbow 53 in turn is connected by a hose 55 to a further coupling 54. A branch pipe 40 supplies washing water to a spray nozzle 40*a* near coupling 54 to wash the exterior of the coupling.

The coupling 54 comprises a male cone 56 co-operable with and sealingly engageable in a female cup 57 which communicates with an outlet 58 leading, for example, to a discharge tank. The male cone is attached to the housing 11 by a linkage assembly 59.

The male cone 56 is carried at the end of the hose 55. Axial guidance is achieved by a guide bearing connected to the linkage assembly 59. The assembly 59 can comprise a gimbal 59*a* and provides freedom of movement in the horizontal plane. A compression spring 60 between the cone and the guide bearing ensures that the cone is urged into sealing engagement with the cup 57 when the housing is lowered into position.

A pressure transducer 61 is fitted where the cone joins the hose and transmits through line 62 the discharge medium pressure to a control panel 63 above the top 12.

When the pump handling machine is lowered into its operating position the male cone automatically centralises in the female cup. With the machine seated, the compression spring 60 applies sufficient force to seal the coupling under normal operating pressure.

A power connection 14*a* to the discharge pump 13 passes through the top 12 to the cable reeling drum 15, which rotates on roller hearings 65 about a stationary cantilevered hollow shaft 64, supported by a bracket 66 depending from the support 23.

The power connection passes through the shaft 64 to a slip ring assembly. The power cable 14, which is connected at one end to the slip ring, is located in a spiral groove formed on the shell of the drum 15. A concave roller 15*a* rotatable on and movable along a spindle ensures the cable is tightly wrapped onto the drum. The other end of the cable 14 is connected to a waterproof socket and plug 67 on the pump mounting plate 24 to supply power to the discharge pump.

The drum 15 is sealed to prevent the ingress of water spray.

The drive transmissions 33, 35, 37 comprise chains the tension in which is adjustable by a bolt eg 33*a* on a bracket mounting the respective hydraulic motor. A housing 33*b* containing two pairs (only one shown) of fibre optic leads 33*c*, 33*d* for monitoring rotation is bolted onto the respective motor bracket. An infra-red through beam from one lead to the other of a pair of leads is interrupted by the links of the chain 33 to produce signals from the roller chain to the control panel via optic box 63*a*. A second pair of leads is provided as a spare. This provides confirmation that the motor is working and provides an indication of the speed of wind-up. The control compares this with a desired speed and changes the hydraulic pressure to the motor accordingly if appropriate. The other motors are arranged similarly.

Quick release fittings 101 on the top of the system supply hydraulic fluid from a power pack 100 to the hydraulic motors and back to the power pack.

The pump mounting plate 24 is supported by two link chains 25 with turnbuckles 70 to adjust the plate level. Guide plates either side of the turnbuckles ensure the pump locates in the housing without jamming.

The chains 25 pass through guide tubes 38, attached to the housing centre section, to limit the pump movement during parking. The chains 25 are driven by wheels 71 mounted at each end of a common shaft 72 supported by roller bearings. The bearings are bolted to a gearbox case 78 which houses a miter gear set, a ratchet mechanism and a proximity sensor target.

Figure 3:
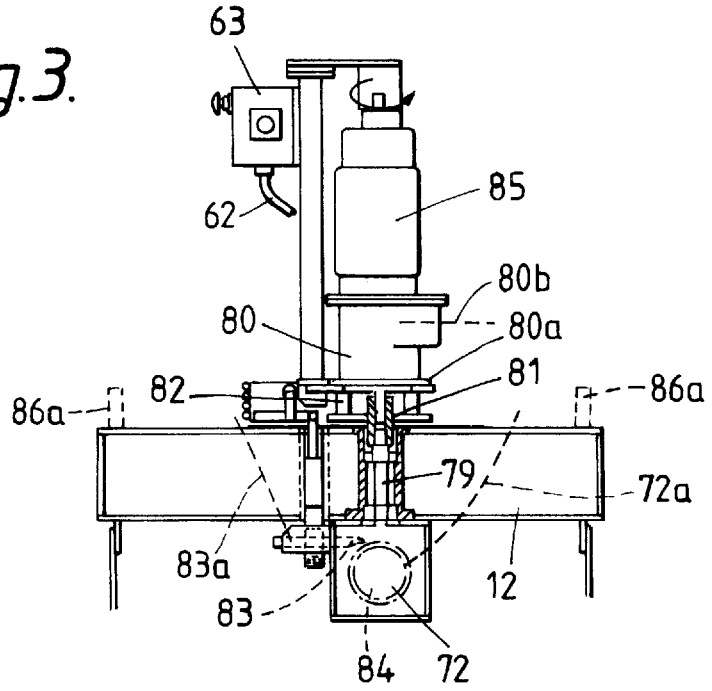
FIG. 3 is a vertical section through a lifting assembly not shown in FIGS. 1, 2.

A splined drive shaft 79 FIG. 3, supported by taper roller bearings, passes through the top 12 perpendicular to the chainwheel shaft 72 and connected to it by a reduction bevel gearset. A gearbox 80 with integral brake has a coupling 81 connected to its output shaft. The gearbox 80 is bolted to a bracket 80*a* which can locate on four pillars 82 screwed into the top 12. As the bracket is lowered onto the pillars 82, using three ratchet handles, the coupling 81 engages on the splined drive shaft 79. When the bracket is lowered further, a cam- operated ratchet pawl 83 disengages from a ratchet wheel 84, keyed to the chainwheel shaft 72, allowing the pump to be power lowered using a motor 85 coupled to gearbox 80. The ratchet 83, 84 stops the chains unwinding under the weight of the pump and provides a mechanical brake when the motor power is removed.

Two proximity switches shown schematically at 72*a* and 83*a* pass through the top 12 and transmit signals back to the control panel 63 from targets on the chainwheel shaft 72 and the ratchet pawl 83. Removal and adjustment of the proximity switches is achieved from the top 12. The sensor 72*a* enables confirmation that the shaft is turning and sensor 83*a* enables confirmation of pawl engagement prior to disconnection of motor 85. A proximity switch shown schematically at 80*b* mounted on the gearbox 80 senses each revolution of the motor 85 and an output signal is transmitted back to the control panel 63.

The two link chains 25 pass over individual actuator mechanisms 86 which transmit the chain loads to load cells 86*a* positioned on the top 12. Signals from the load cells are fed to the control panel 63.

As the chains 25 pass over the drive wheels 71, the chains are protected by a guard 87 which guides the respective chain and prevents chain jump. The unloaded lengths of chain are collected in boxes 88 bolted to the underside of the top 12. The end links of the chains 25 are connected to the respective box by means of a bolt.

When the pump is being raised to the parked position, two plungers 90, mounted to cross-members in the housing lower section, are triggered by making contact with the pump mounting plate 24. The plungers are mounted in a housing containing two pairs of fibre optic leads 89. An infra-red through-beam from one lead to the other lead of the pair is interrupted by movement of the associated plunger and this sends a signal back to the control panel 63 to stop the raise/lower drive motor 85. The second pair of leads on the bracket is a spare.

In operation, as the pump is raised at a uniform speed from a lowered position by motor 85 via chains 25, the slack in the hoses 21 and 17 and in the cable 14 is taken up by the respective winding drum and hydraulic motor. As the pump is being raised, the weight of the hoses and cables not wound on the respective drum decreases and to maintain uniform wind up speed the hydraulic pressure fed to the motors is reduced.

The maximum height of raise of the pump is divided into twenty equal steps and the pull on the hoses and cable needed to prevent slack (but not strain the hoses or cable) at each step was determined by experiment or test and the appropriate hydraulic pressure for each step thus derived.

The control 63 includes a programmable logic computer (PLC) which is programmed with these pressures. The height of the pump at a given moment is derived from the signals from the proximity switch 80*b* to act as a depth counter, for example by comparison with a lookup table. The height between lowest and highest pump positions is similarly divided into twenty equal steps.

The control unit 63 thus varies for each step the hydraulic pressure supplied to the motors corresponding to the actual height of the pump. The height could be divided into more than twenty steps.

During lowering of the pump, the hoses and cable are fed off the respective drum by gravity.

When raising the pump from an initial stationary position, a boost or higher-than-appropriate hydraulic pressure is temporarily supplied to the motors to overcome initial inertia.

I claim:

1. Handling apparatus for a pump, said apparatus comprising a first drum associated with a first hose for supplying fluid to the pump, a first motor for rotating the first drum to wind the first hose onto the first drum, a second drum associated with a second hose for discharge of fluid medium by the pump, a second motor for rotating the second drum to wind the second hose onto the second drum, a third drum associated with electric cable for the pump, and a third motor for rotating the third drum to wind the cable onto the third drum, and controlling means being operative to control the first, second and third motors in a predetermined varying manner in dependence on the varying but currently unwound amount of the respective hose or cable to avoid slack in the first and second hoses and the cable during winding rotation of the first drum, the second and the third drum.

2. Apparatus as claimed in claim 1, in which the first and second and third motors are hydraulic motors.

3. Apparatus as claimed in claim 1 including a support on which a pump can be mounted, and means for raising and lowering the support.

4. Apparatus as claimed in claim 1 in which the control means comprises means for maintaining the wind up speed substantially irrespective of the weight of the respective hose or cable unwound from the respective drum.

5. Apparatus as claimed in claim 4, in which the wind-up speed is maintained by varying the energy supply to the respective motor in dependence on the height of the pump support.

6. Apparatus as claimed in claim 5, including means for varying the energy supply in a plurality of discrete steps.

* * * * *